US009989904B2

(12) United States Patent
Arai et al.

(10) Patent No.: US 9,989,904 B2
(45) Date of Patent: Jun. 5, 2018

(54) FIXING DEVICE AND IMAGE FORMING APPARATUS FOR PREVENTING SEPARATION OF A FIXING ROTATOR AND A HOLDER

(71) Applicants: Yuji Arai, Miyagi (JP); Hajime Gotoh, Kanagawa (JP); Takuya Seshita, Kanagawa (JP); Takahiro Imada, Kanagawa (JP)

(72) Inventors: Yuji Arai, Miyagi (JP); Hajime Gotoh, Kanagawa (JP); Takuya Seshita, Kanagawa (JP); Takahiro Imada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/295,439

(22) Filed: Oct. 17, 2016

(65) Prior Publication Data

US 2017/0131665 A1 May 11, 2017

(30) Foreign Application Priority Data

Nov. 9, 2015 (JP) ..... 2015-219564

(51) Int. Cl.
*G03G 15/20* (2006.01)

(52) U.S. Cl.
CPC ..... *G03G 15/2053* (2013.01); *G03G 15/2017* (2013.01); *G03G 2215/2035* (2013.01)

(58) Field of Classification Search
CPC ..... G03G 15/2053; G03G 15/2017; G03G 21/1685; G03G 2215/2035; G03G 2221/1639
USPC ..... 399/122, 329
See application file for complete search history.

(56) References Cited

U.S. PATENT DOCUMENTS 8,626,048 B2 * 1/2014 Arimoto ..... G03G 15/2053 399/328
8,725,038 B2 * 5/2014 Yamaguchi ..... G03G 15/2053 399/122
8,886,101 B2 * 11/2014 Kawata ..... G03G 15/2053 399/329

(Continued)

FOREIGN PATENT DOCUMENTS

JP 2007-334205 12/2007
JP 2009-042305 2/2009

(Continued)

*Primary Examiner* — Robert Beatty
(74) *Attorney, Agent, or Firm* — Oblon, McClelland, Maier & Neustadt, L.L.P.

(57) ABSTRACT

A fixing device includes a fixing rotator unit. The fixing rotator unit includes a fixing rotator formed into a loop; a holder to hold an end in a longitudinal direction of the fixing rotator; a pressure rotator disposed opposite the fixing rotator to press against the fixing rotator; a pressure pad disposed inside the loop to receive pressure from the pressure rotator via the fixing rotator to form an area of contact between the fixing rotator and the pressure rotator; a stay to support the pressure pad against the pressure from the pressure rotator; and a positioner to secure the holder and to position the stay with one end of the stay projecting outwards from the positioner. The positioner has a limited moving distance in a thrust direction. The limited moving distance is shorter than a length of a part of the holder entering the loop.

5 Claims, 7 Drawing Sheets

(56) References Cited

U.S. PATENT DOCUMENTS

| | | | | |
|---|---|---|---|---|
| 8,918,043 | B2 * | 12/2014 | Yoshida | G03G 15/2085 219/216 |
| 9,513,583 | B2 * | 12/2016 | Ohta | G03G 15/2053 |
| 2005/0185994 | A1 * | 8/2005 | Inada | G03G 15/2053 399/328 |
| 2007/0292175 | A1 | 12/2007 | Shinshi | |
| 2011/0058862 | A1 | 3/2011 | Yamaguchi et al. | |
| 2011/0116848 | A1 | 5/2011 | Yamaguchi et al. | |
| 2012/0121305 | A1 | 5/2012 | Yoshikawa et al. | |
| 2012/0148303 | A1 | 6/2012 | Yamaguchi et al. | |
| 2013/0045032 | A1 | 2/2013 | Shimokawa et al. | |
| 2013/0164056 | A1 | 6/2013 | Imada et al. | |
| 2013/0170879 | A1 | 7/2013 | Yoshinaga et al. | |
| 2013/0195525 | A1 | 8/2013 | Yoshinaga et al. | |
| 2013/0209147 | A1 | 8/2013 | Ogawa et al. | |
| 2014/0072355 | A1 | 3/2014 | Tamaki et al. | |
| 2014/0356036 | A1 | 12/2014 | Shimokawa et al. | |
| 2015/0168897 | A1 | 6/2015 | Ogawa et al. | |
| 2015/0261147 | A1 | 9/2015 | Arai et al. | |
| 2016/0062286 | A1 | 3/2016 | Yoshiura et al. | |

FOREIGN PATENT DOCUMENTS

| | | | | |
|---|---|---|---|---|
| JP | 2015075577 | A | * | 4/2015 |
| JP | 2015081946 | A | * | 4/2015 |
| JP | 2015-175968 | | | 10/2015 |
| JP | 2016-040566 | | | 3/2016 |

* cited by examiner

FIXING DEVICE AND IMAGE FORMING APPARATUS FOR PREVENTING SEPARATION OF A FIXING ROTATOR AND A HOLDER

CROSS-REFERENCE TO RELATED APPLICATION

This patent application is based on and claims priority pursuant to 35 U.S.C. § 119(a) to Japanese Patent Application No. 2015-219564, filed on Nov. 9, 2015, in the Japan Patent Office, the entire disclosure of which is hereby incorporated by reference herein.

BACKGROUND

Technical Field

Embodiments of the present disclosure generally relate to a fixing device and an image forming apparatus, and more particularly, to a fixing device for fixing a loner image on a recording medium, and an image forming apparatus incorporating the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such a fixing device typically includes a fixing rotator such as a roller, a belt, or a film, and an opposed rotator such as a roller or a belt pressed against the fixing rotator. The toner image is fixed onto the recording medium under heat and pressure while the recording medium is conveyed between the fixing rotator and the opposed rotator.

SUMMARY

In one embodiment of the present disclosure, a novel fixing device is described that includes a fixing rotator unit, which includes a fixing rotator, a holder, a pressure rotator, a pressure pad, a stay, and a positioner. The fixing rotator is formed in so a loop. The holder holds an end in a longitudinal direction of the fixing rotator. The pressure rotator is disposed opposite the fixing rotator to press against the fixing rotator. The pressure pad is disposed inside the loop formed by the fixing rotator to receive pressure from the pressure rotator via the fixing rotator to form an area of contact between the fixing rotator and the pressure rotator. The stay supports the pressure pad against the pressure from the pressure rotator. The positioner secures the holder and positions the stay with one end of the stay projecting outwards from the positioner. The positioner has a limited moving distance in a thrust direction. The limited moving distance is shorter than a length of a part of the holder entering the loop formed by the fixing rotator.

Also described is a novel image forming apparatus incorporating the fixing device.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
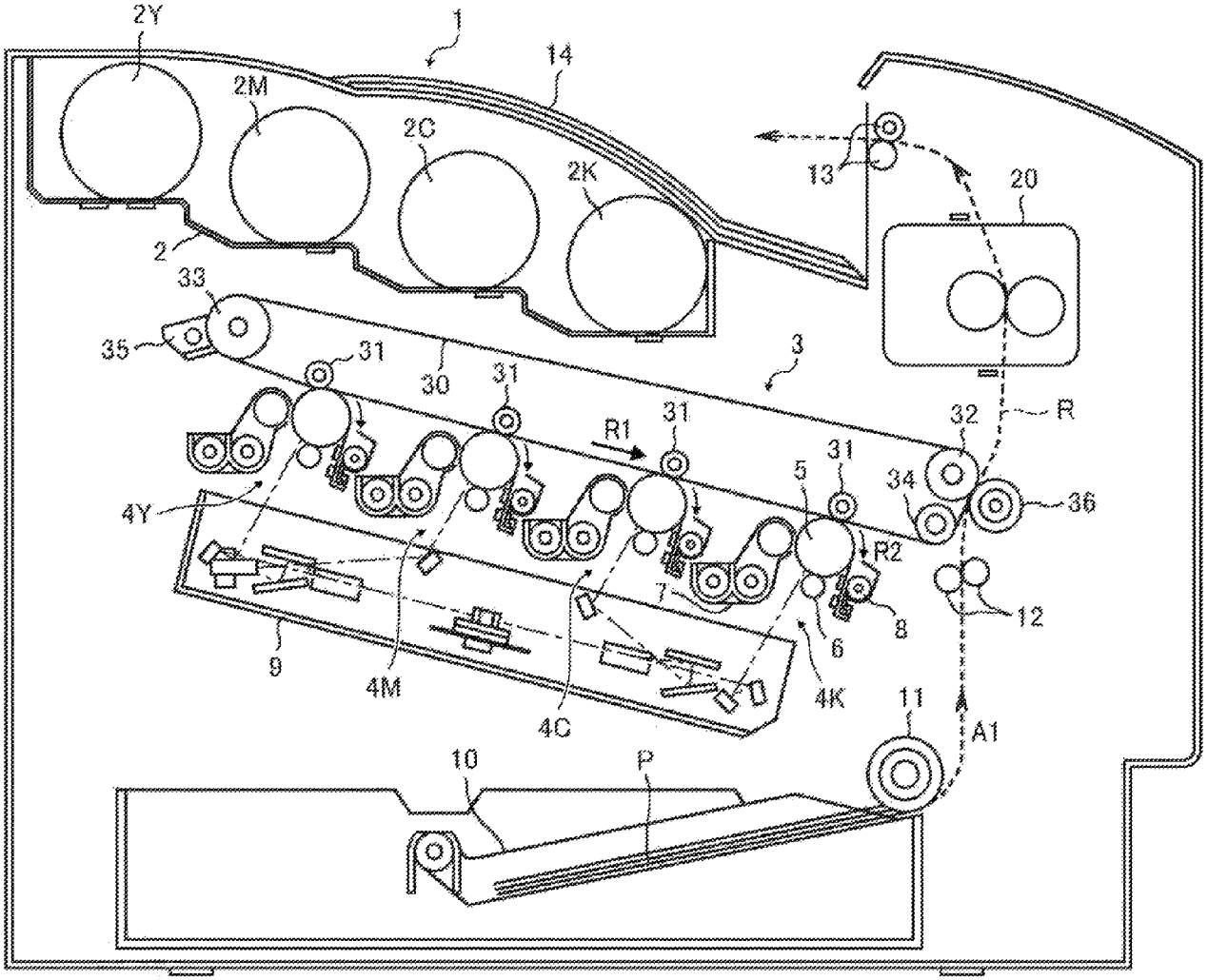
FIG. 1 is a schematic view of an image forming apparatus according to an embodiment of the present disclosure.

In describing embodiments illustrated in the drawings, specific terminology is employed for the sake of clarity. However, the disclosure of this patent specification is not intended to be limned to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, M, C, and K denote colors yellow, magenta, cyan, and black, respectively. To simplify the description, these suffixes are omitted unless necessary.

Referring now to the drawings, embodiments of the present disclosure are described below.

Initially with reference to FIG. 1, a description is given of overall configuration and operation of an image forming apparatus 1 according to an embodiment of the present disclosure.

FIG. 1 is a schematic view of the image forming apparatus 1.

In the present embodiment, the image forming apparatus 1 a tandem color laser printer that forms color and monochrome images on recording media by electrophotography. The image forming apparatus 1 includes four image forming devices 4Y, 4M, 4C, and 4K in the center of a housing of the image forming apparatus 1. The image forming devices 4Y, 4M, 4C, and 4K have identical configurations while containing different colors of toner as developer. Specifically, the image forming devices 4Y, 4M, 4C, and 4K accommodate toner of yellow (Y), magenta (M), cyan (C), and black (K), respectively. The colors yellow, magenta, cyan, and black correspond to color separation components of a color image. A detailed description is now given of the image tanning device 4K as a representative of the image forming devices 4.

The image forming device 4K includes, e.g., a drum-shaped photoconductor 5 as a latent image bearer, a charger 6 that charges the surface of the photoconductor 5, a developing device 7 that supplies toner to the surface of the photoconductor 5, and a cleaner 8 that cleans the surface of the photoconductor 5.

Below the image forming devices 4Y, 4M, 4C, and 4K is an exposure device 9 that exposes the surface of the photoconductor 5. The exposure device 9 includes, e.g., a light source, a polygon mirror, an f-θ lens, and a reflection mirror to irradiate the surface of the photoconductor 5 with a laser beam according to image data.

A transfer device 3 is disposed above the image forming devices 4Y, 4M, 4C, and 4K. The transfer device 3 includes an intermediate transfer belt 30 as an intermediate transfer body, four primary transfer rollers 31 as primary transfer devices, a secondary transfer roller 36 as a secondary transfer device, a secondary transfer backup roller 32, a cleaning backup roller 33, a tension roller 34, and a belt cleaner 35.

The intermediate transfer belt 30 is an endless best entrained around the secondary transfer backup roller 32, the cleaning backup roller 33, and the tension roller 34. In the present embodiment, as a driver drives and rotates the secondary transfer backup roller 32 in a counterclockwise direction, the intermediate transfer belt 30 rotates in a rotational direction R1 as illustrated in FIG. 1 by friction therebetween.

The four primary transfer rollers 31 sandwich the intermediate transfer belt 30 together with the respective photoconductors 5, thereby forming four primary transfer areas herein called primary transfer nips between the intermediate transfer belt 30 and the photoconductors 5. The primary transfer rollers 31 are connected to a power supply that applies a predetermined direct current (DC) voltage and/or alternating current (AC) voltage to each of the primary transfer rollers 31.

The secondary transfer roller 36 sandwiches the intermediate transfer belt 30 together with the secondary transfer backup roller 32, thereby forming a secondary transfer area herein called a secondary transfer nip between the secondary transfer roller 36 and the intermediate transfer belt 30. Similar to the primary transfer rollers 31, the secondary transfer roller 36 is connected to the power supply that applies a predetermined DC voltage and/or AC voltage to the secondary transfer roller 36.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 is disposed in an upper portion of the housing of the image forming apparatus 1. The bottle holder 2 accommodates removable four toner bottles 2Y, 2M, 2C, and 2K that contain fresh toner of yellow, magenta, cyan, and black, respectively. A toner supply tube is interposed between each of the toner bottles 2Y, 2M, 2C, and 2K and the corresponding developing device 7. The fresh toner is supplied from each of the toner bottles 2Y, 2M, 2C, and 2K to the corresponding developing device 7 through the toner supply tube.

In a lower portion of the housing of the image forming apparatus 1 are, e.g., a sheet tray 10 and a sheet feeding roller 11. The sheet tray 10 accommodates a plurality of sheets P as recording media. The sheet feeding roller 11 picks up and feeds the plurality of sheets P one at a time from the sheet tray 10 toward the secondary transfer nip formed between the secondary transfer roller 36 and the intermediate transfer belt 30. The sheets P as recording media may be plain paper, thick paper, postcards, envelopes, thin paper, coated paper, art paper tracing paper, overhead projector (OHP) transparencies, and the like.

Optionally, the image forming apparatus 1 may include a bypass feeder to place such recording media on the bypass feeder.

In the housing of the image forming apparatus 1 is a conveyance passage R defined by internal components of the image forming apparatus 1. Along the conveyance passage R, the sheet P is conveyed from the sheet tray 10 to a sheet ejection roller pair 13 via the secondary transfer nip. The sheet ejection roller pair 13 ejects the sheet P outside the housing of the image forming apparatus 1. Along the conveyance passage R are, e.g., a registration roller pair 12, a fixing device 20, and the sheet ejection roller pair 13. The registration roller pair 12 is disposed upstream from the secondary transfer roller 36 in a sheet conveyance direction A1 as a recording medium convey ante direction. The registration roller pair 12 as a conveyance device conveys the sheet P to the secondary transfer nip.

The fixing device 20 is disposed downstream from the secondary transfer roller 36 in the sheet conveyance direction A1. The sheet ejection roller pair 13 is disposed downstream from the fixing device 20 in the sheet conveyance direction A1, to eject the sheet P onto an output tray 14. The output tray 14 is disposed atop the housing of the image forming apparatus 1. The plurality of sheets P ejected by the sheet ejection roller pair 13 rests on the output tray 14 one by one.

Optionally, the image forming apparatus 1 may include a sheet reverse mechanism for duplex printing.

With continued reference to FIG. 1, a description is given of a basic image forming operation of the image forming apparatus 1. When a print job starts, a driver drives and rotates the photoconductor 5 of each of the image forming devices 4Y, 4M, 4C and 4K in a rotational direction R2, which is a clockwise direction in FIG. 1. The charger 6 uniformly charges the surface of the photoconductor 5 to a predetermined polarity. The exposure device 9 irradiates the surface of the photoconductor 5 thus charged with a laser beam to form an electrostatic latent image on the surface of the photoconductor 5 according to image data. It is to be noted that the image data is single-color image data obtained by separating a desired full-color image into individual color components, that is, yellow, magenta, cyan black components. The developing device 7 supplies toner to the electrostatic latent images thus formed on the surface of the photoconductor 5 to render the electrostatic latent image visible as a toner image.

Meanwhile, when the print job starts, the driver drives and rotates the secondary transfer backup roller 32 in the counterclockwise direction in FIG. 1 to rotate the intermediate transfer belt 30 in the rotational direction R1. The power supply applies a constant voltage or constant current control voltage having a polarity opposite a polarity of the toner to each of the primary transfer rollers 31. Accordingly, a transfer electric field is generated at each of the primary transfer nips between the primary transfer rollers 31 and the respective photoconductors 5.

When the toner image formed on the photoconductor 5 reaches the primary transfer nip in accordance with rotation of the photoconductor 5, the transfer electric field thus generated transfers the loner image from the photoconductor 5 onto the intermediate transfer belt 30. Specifically, toner images of yellow, magenta, cyan, and black are superimposed one atop another while being transferred onto the intermediate transfer belt 30. Thus, a full-color toner image is formed on the surface of the intermediate transfer belt 30. The cleaner 8 removes residual toner, failed to be transferred to the intermediate transfer belt 30 and therefore remaining on the surface of the photoconductor 5, from the photoconductor 5. Then, a discharger discharges the surface of the photoconductor 5 to initialize the surface potential of the photoconductor 5.

In the lower portion of the image forming apparatus 1, the sheet feeding roller 11 starts rotation to feed the sheet P from the sheet tray 10 toward the registration roller pair 12 along the conveyance passage R. The registration roller pair 12 is timed to convey the sheet P to the secondary transfer nip between the secondary transfer roller 36 and the intermediate transfer belt 30 so that the sheet P meets the full-color toner image formed on the surface of the intermediate transfer belt 30 at the secondary transfer nip. The secondary transfer roller 36 is applied with a transfer voltage having a polarity opposite a polarity of the charged toner contained in the full-color toner image formed on the intermediate transfer belt 30, thereby generating a transfer electric field at the secondary transfer nip.

When the full-color toner image formed on the intermediate transfer belt 30 reaches the secondary transfer nip in accordance with rotation of the intermediate transfer belt 30, the transfer electric field thus generated transfers the toner images of yellow, cyan, magenta, and black constructing the full-color toner image from the intermediate transfer belt 30 onto the sheet P collectively. The belt cleaner 35 removes residual toner, failed to be transferred onto the sheet P and therefore remaining on the intermediate transfer belt 30, from the intermediate transfer belt 30. The removed toner is conveyed and collected into the waste toner container.

The sheet P bearing the full-color loner image is conveyed to the fixing device 20 that fixes the full-color toner image onto the sheet P. Then, the sheet P bearing the fixed full-color toner image is conveyed to the sheet ejection roller pair 13 that ejects the sheet P onto the output tray 14 atop the image forming apparatus 1. Thus, the plurality of sheets P rests on the output tray 14.

As described above, the image forming apparatus 1 forms a full-color image on a recording medium. Alternatively, the image forming apparatus 1 may use one of the image forming devices 4Y, 4M, 4C, and 4K to form a monochrome image, or may use two or three of the image forming devices 4Y, 4M, 4C, and 4K to form a bicolor or tricolor image, respectively.

Figure 2:
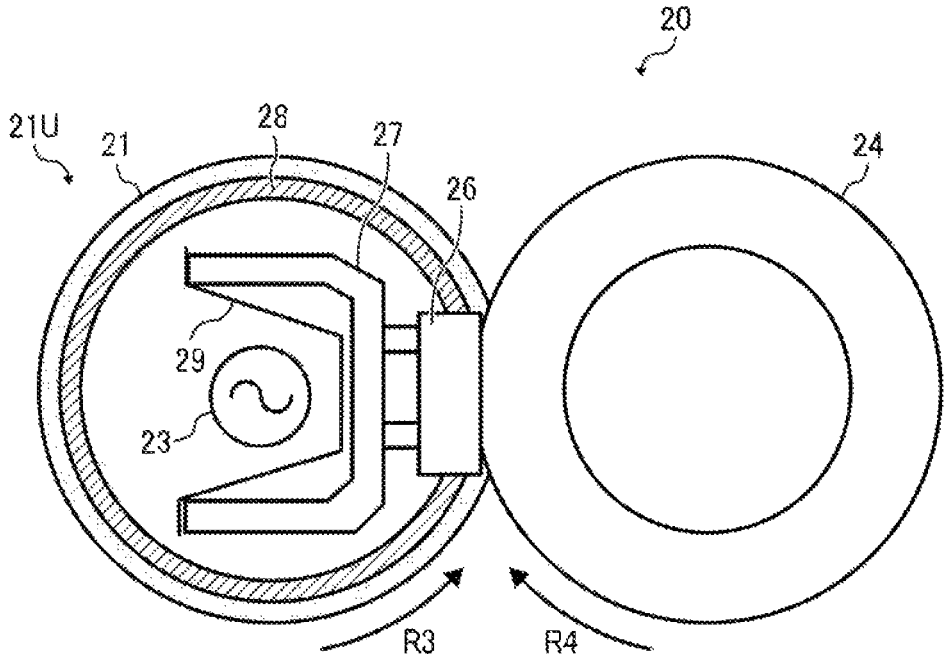
FIG. 2 is a cross-sectional view of a fixing device incorporated in the image forming apparatus of FIG. 1.

Referring now to FIG. 2, a description is given of a basic construction of the fixing device 20 incorporated in the image forming apparatus 1 described above.

FIG. 2 is a cross-sectional view of the fixing device 20.

The fixing device 20 (e.g., a fuser or a fuser unit) includes, e.g., a fixing belt 21 as a fixing rotator formed into a loop and rotatable in a rotational direction R3, and a pressure roller 24 as a pressure rotator that contacts an outer circumferential surface of the fixing belt 21 and is rotatable in a rotation direction R4. The fixing device 20 further includes a heater 23, a nip formation pad 26, a stay 27, a holder 28, and a reflector 29 inside the loop formed by the fixing belt 21. The fixing belt 21 and the components disposed inside the loop formed by the fixing belt 21, that is, the heater 23, the nip formation pad 26, the stay 27, the holder 28, and the reflector 29, may constitute a belt unit 21U detachably coupled to the pressure roller 24.

The heater 23 is disposed opposite an inner circumferential surface of the fixing belt 21 to heat the fixing belt 21 directly from an inner circumferential side of the fixing belt 21.

The nip formation pad 26 as a pressure pad is disposed opposite the pressure roller 24 via the fixing belt 21 to form a contact area herein called a fixing nip between the fixing belt 21 and the pressure roller 24, together with the pressure roller 24. As the fixing belt 21 rotates in the rotational direction R3, the fixing belt 21 slides over the nip formation pad 26 directly, or indirectly via a low-friction sheet. The nip formation pad 26, made of a heat-resistant material, is elongated in a width direction of the fixing belt 21, that is, longitudinal direction of the pressure roller 24.

In the present embodiment, the fixing nip is flat as illustrated in FIG. 2. Alternatively, the fixing nip may be given a concave shape, curving toward the nip formation pad 26. Such a configuration directs a leading edge of the sheet P toward the pressure roller 24 as the sheet P is ejected from the fixing nip, thereby facilitating separation of the sheet P from the fixing belt 21 and preventing a paper jam.

The fixing belt 21 is a thin, flexible endless belt or film made of metal, such as nickel or stainless steel (e.g., steel use stainless or SUS), or resin such as polyimide. The fixing belt 21 is constructed of a base layer, an elastic layer, and a release layer. The release layer, as an outer surface layer of the fixing belt 21, is made of tetrafluoroethylene-perfluoroalkyl vinyl ether copolymer (PFA), polytetrafluoroethylene (PTFE), or the like to facilitate separation of toner of the toner image on the sheet P from the fixing belt 21. The elastic layer is interposed between the base layer and the release layer, and made of silicone rubber or the like. Omitting the elastic layer as an intermediate layer may allow the fixing belt 21 to have a decreased thermal capacity that improves fixing property of being heated quickly to a predetermined fixing temperature at which the toner image is fixed on the sheet P. However, as the pressure roller 24 and the fixing belt 21 sandwich and press the toner image on the sheet P passing through the fixing nip, slight surface asperities of the fixing belt 21 may be transferred onto the toner image on the sheet P, resulting in variation in gloss of the solid toner image that may appear as an orange peel image on the sheet P. To address this circumstance, the elastic layer made of silicone rubber has a thickness not smaller than about 100 micrometers. As the elastic layer deforms, the elastic layer absorbs slight surface asperities of the fixing belt 21 to provide improved imaging quality.

The stay 27, situated inside the loop formed by the fixing belt 21, supports the nip formation pad 26 as a support. As the nip formation pad 26 receives pressure from the pressure roller 24, the stay 27 supports the nip formation pad 26 to prevent bending of the nip formation pad 26, determine the position of the fixing nip, and produce an even nip width in an axial direction of the fixing belt 21 or the pressure roller 24. The stay 27 is made of metal such as stainless steel, iron, or aluminum. Each lateral end of the stay 27, that is, each end in a longitudinal direction of the stay 27 parallel to the axial direction of the fixing belt 21, is secured to and thus held by the holder 28 with a flange held by a positioner 22 mounted on a side-plate frame of the fixing device 20 as a fixing unit. Thus, the stay 27 is secured at a predetermined position inside the fixing device 20. The stay 27 is a basic component that determines the relative positions of the fixing belt 21 and the components disposed inside the loop formed by the fixing belt 21. Specifically, the components are disposed inside the loop formed by the fixing belt 21 with reference to the stay 27, thereby accurately determining the relative positions of the fixing belt 21 and the components disposed inside the loop formed by the fixing belt 21. The reflector 29 (e.g., a reflection plate) is secured to a face of the stay 27 facing the heater 23. The reflector 29 reflects light radiated from the heater 23 to the stay 27 toward the inner circumferential surface of the fixing belt 21, thereby preventing the stay 27 from being heated unnecessarily by the heater 23 and suppressing waste of energy. Alternatively, instead of the reflector 29, the face of the stay 27 facing the heater 23 may be insulated or given a mirror finish to reflect light radiated from the heater 23 to the stay 27 toward the fixing belt 21. In the present embodiment, the reflector 29 includes an aluminum base having a surface treated with silver-vapor-deposition. Alternatively, the reflector 29 may be made of a material other than aluminum or silver. However, silver having a decreased emissivity reflects light radiated from the heater 23 to the stay 27 toward the fixing belt 21, allowing the fixing belt 21 to absorb heat from the heater 23 effectively. The heater 23 may be a halogen heater, an induction heater, a resistance heat generator, a carbon heater, or the like.

The pressure roller 24 is constructed of a metal core, an elastic layer coating the metal core and made of rubber, and a surface release layer coating the elastic layer and made of PFA or PTFE to facilitate separation of the sheet P from the pressure roller 24. As a driving force generated by a driver (e.g., a motor) situated inside the image forming apparatus 1 is transmitted to the pressure roller 24 through a gear train, the pressure roller 24 rotates in the rotation direction R4. A spring or other biasing mechanism presses the pressure roller 24 against the nip formation pad 26 via the fixing belt 21. The pressure roller 24 may be either hollow or solid. If the pressure roller 24 is a hollow roller, a heater such as a halogen heater may be disposed inside the hollow roller. The elastic layer may be made of solid rubber. Alternatively, if no heater is situated inside the pressure roller 24, the elastic layer may be made of sponge rubber. The sponge rubber is more preferable than the solid rubber because the sponge rubber has an increased insulation that draws less heat from the fixing belt 21.

As the pressure roller 24 rotates in the rotation direction R4, the fixing belt 21 rotates in the rotation direction R3 by friction therebetween. For example, as the driving force generated by the driver drives and rotates the pressure roller 24 as described above, the driving force is transmitted from the pressure roller 24 to the fixing belt 21 at the fixing nip, to rotate the fixing belt 21 in the rotation direction R3. At the fixing nip, the fixing belt 21 rotates while being sandwiched between the pressure roller 24 and the nip formation pad 26. On the other hand, at a circumferential span of the fixing belt 21 other than the fixing nip, the fixing belt 21 rotates while being guided by the flange of the holder 28 at each lateral end of the fixing belt 21. The lateral end of the fixing belt 21 is an end in the axial direction of the fixing belt 21, that is, longitudinal direction of the fixing belt 21. Thus, the holder 28 prevents meandering of the fixing belt 21 while supporting the fixing belt 21. In addition, the holder 28 holds the components disposed inside the loop formed by the fixing belt 21, such as the heater 23, the nip formation pad 26, and the stay 27.

Usually, fixing devices that incorporate a thin belt or film as a fixing rotator have the basic construction described above. Since such a thin fixing rotator is inherently weak, the fixing devices are to be assembled with extra care.

To improve the assembly efficiency, for example, to prevent damages on the fixing rotator upon incorporation of a holder that supports the fixing rotator in the fixing devices, typical fixing devices may include a fixing rotator formed into a loop; a heat source to heat the fixing rotator; a counter rotator to contact and press against the fixing rotator to form a fixing nip between the fixing rotator and the counter rotator; a shield disposed inside the loop formed by the fixing rotator to partially shield heat from the heat source; and a holder attached to an end of the fixing rotator. The shield includes a spacer to define a clearance between an end of the shield and an inner surface of an end of the fixing rotator facing the end of the shield to allow the holder to be inserted into the clearance.

Such a configuration may improve incorporation of the holder in the fixing devices. However, upon incorporation of the fixing rotator in the fixing devices, the fixing rotator so ay separate from the holder that holds the fixing rotator and a positioner that holds the holder, resulting in damages on the fixing rotator.

Figure 3A:
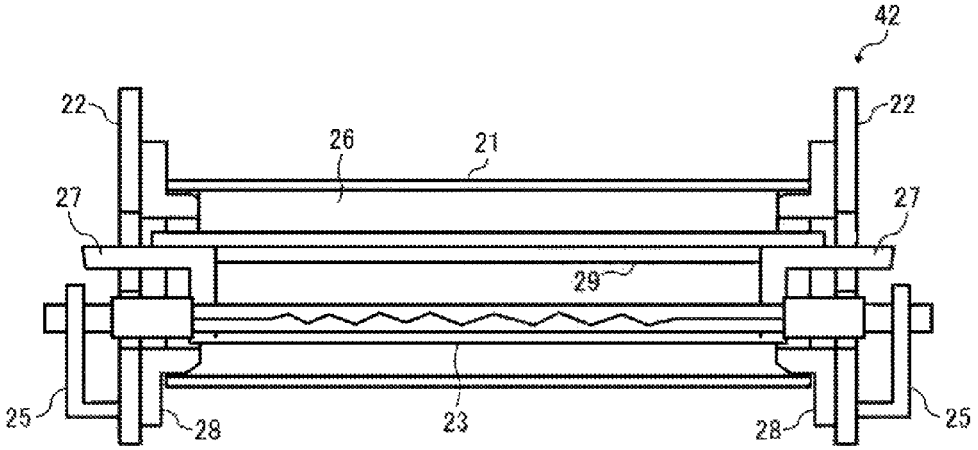
FIG. 3A is a cross-sectional view of a fixing rotator unit incorporated in the fixing device of FIG. 2.
Figure 3B:
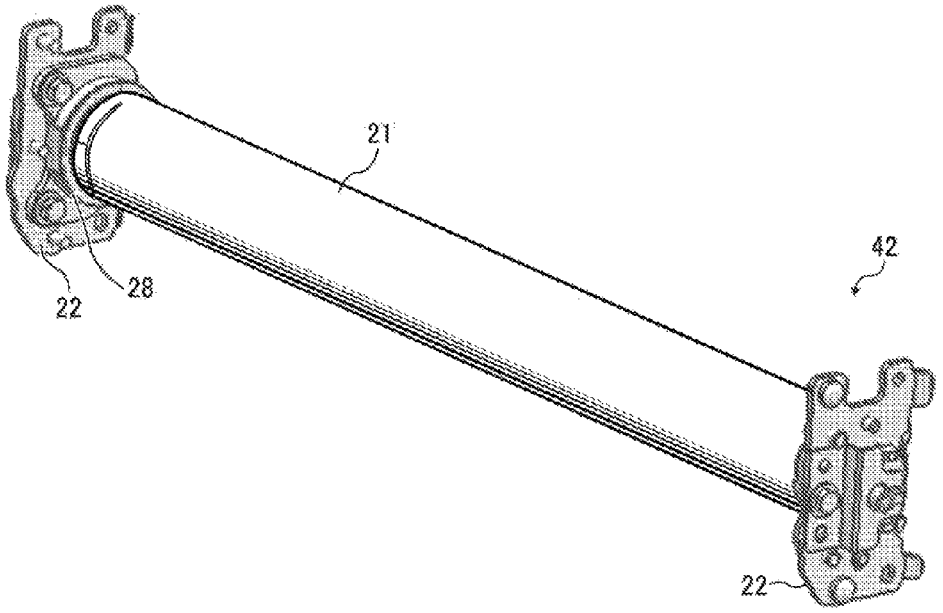
FIG. 3B is a perspective view of the fixing rotator unit of FIG. 3A.
Figure 4:
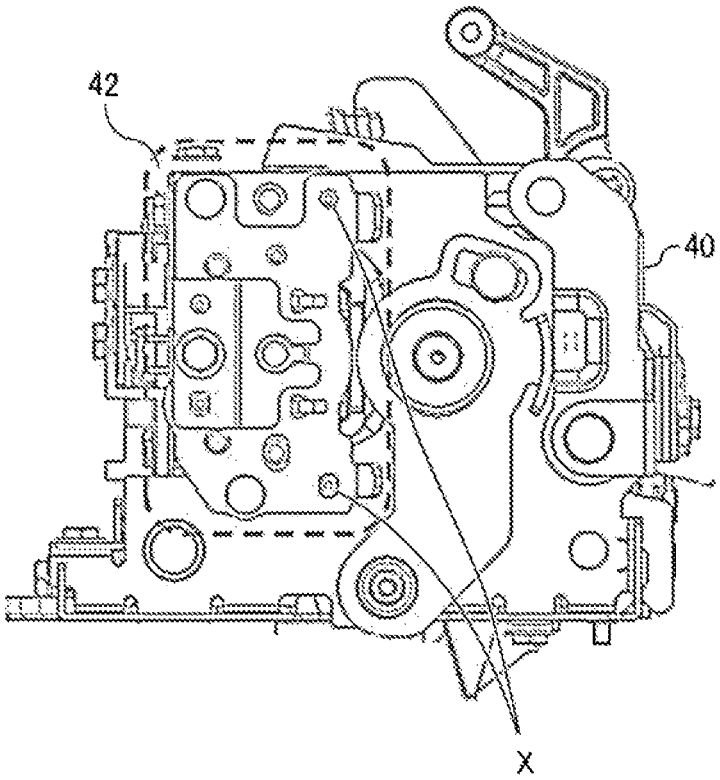
FIG. 4 is a schematic end view of the fixing device of FIG. 2, illustrating the fixing rotator unit secured to a housing of the fixing device.

Referring now to FIGS. 3A through 4, a description is given of a fixing rotator unit 42 constructed of the fixing belt 21 and associated components in the fixing device 20 described above.

FIG. 3A is a cross-sectional view of the fixing rotator unit 42. FIG. 3B is a perspective view of the fixing rotator unit 42. FIG. 4 is a schematic end view of the fixing device 20, illustrating the fixing rotator unit 42 secured to a housing 40 of the fixing device 20 at positions X.

The fixing rotator unit 42, removable from the housing 40 of the fixing device 20, includes the fixing belt 21, the positioner 22, the heater 23, a heater holder 25, the nip formation pad 26, the stay 27, the holder 28, and the reflector 29. The holder 28 holds each lateral end of the fixing belt 21. In other words, the holder 28 holds each end in the width direction of the fixing belt 21, that is, longitudinal direction of the fixing belt 21. The holder 28 is held by the positioner 22, as a unit frame of the fixing rotator unit 42. The positioner 22 is mounted on the side-plate frame of the housing 40 of the fixing device 20 when incorporated in the fixing device 20. As illustrated in FIG. 3A, each lateral end of the stay 27 is disposed through the positioner 22, thereby being held in a height direction and positioned in a pressure direction as a unit. The heater holder 25 secured to the positioner 22 holds the heater 23. Thus, in the present embodiment, the fixing rotator unit 42 is constructed.

Figure 5A:
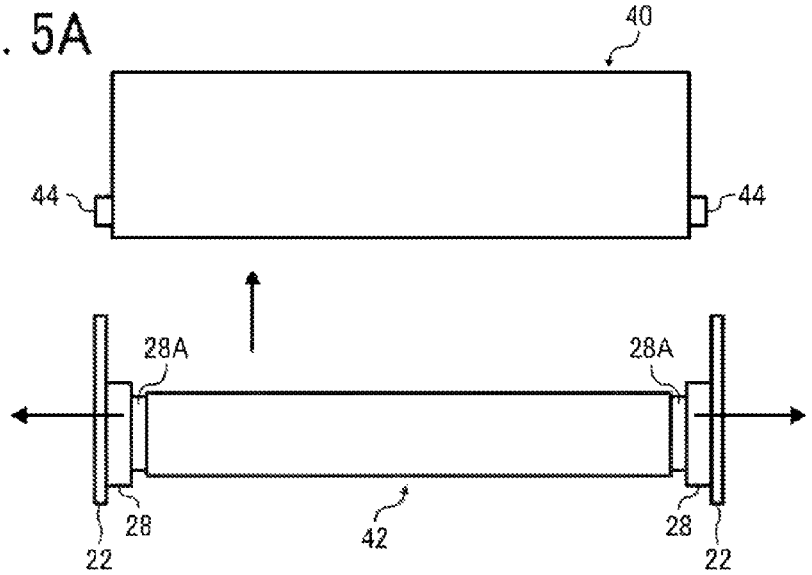
FIG. 5A is a cross-sectional view of the fixing rotator unit and the housing of the fixing device before assembly.
Figure 5B:
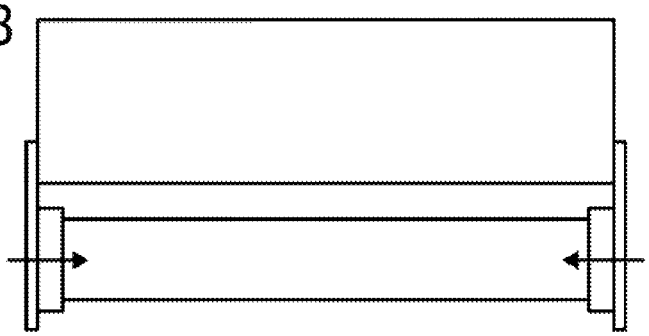
FIG. 5B is a cross-seasonal view of the fixing rotator unit and the housing of the fixing device after assembly.

Referring now to FIGS. 5A and 5B, a description is given of mounting the fixing rotator unit 42 on the housing 40 of the fixing device 20.

FIG. 5A is a cross-sectional view of the fixing rotator unit 42 and the housing 40 of the fixing device 20 before assembly. FIG. 5B is a cross-sectional view of the fixing rotator unit 42 and the housing 40 of the fixing device 20 after assembly.

As illustrated in FIG. 5A, the fixing rotator unit 42 approaches the housing 40 with the positioner 22 and the holder 28 of the fixing rotator unit 42 opened or moved outwards as illustrated in FIG. 5A. As illustrated in FIG. 5B, the fixing rotator unit 42 is secured to the housing 40 at positions X illustrated in FIG. 4 with the positioner 22 and the holder 28 closed or moved inwards. Typically, positioning bosses 44 are mounted on opposed ends of the housing 40 and fitted into positioning holes of the fixing rotator unit 42 to position the fixing rotator unit 42 with respect to the housing 40 of the fixing device 20. Alternatively, the fixing rotator unit 42 may be provided with the positioning bosses 44 whereas the housing 40 may be provided with the positioning holes.

Typically, in such a positioning configuration, the positioning is performed in a thrust direction, in which a thrust is generated, of the side-plate frame. Therefore, the positioner as a part of the fixing rotator unit is to be moved in the thrust direction. In addition, such a configuration may separate the fixing belt from the holder when the fixing rotator unit is mounted on the housing of the fixing device.

Hence, in the present embodiment, a moving distance of the positioner 22 in the axial direction of the fixing belt 21, that is, width direction of the fixing belt 21, is shorter than the length of a part 28A, illustrated in FIG. 5A, of the holder 28 that holds each lateral end of the fixing belt 21. The part 28A of the holder 28 is a part entering the loop formed by the fixing belt 21. Such a configuration prevents separation of the fixing belt 21 front the holder 28 when the fixing rotator unit 42 is mounted on the housing 40 of the fixing device 20.

Figure 6:
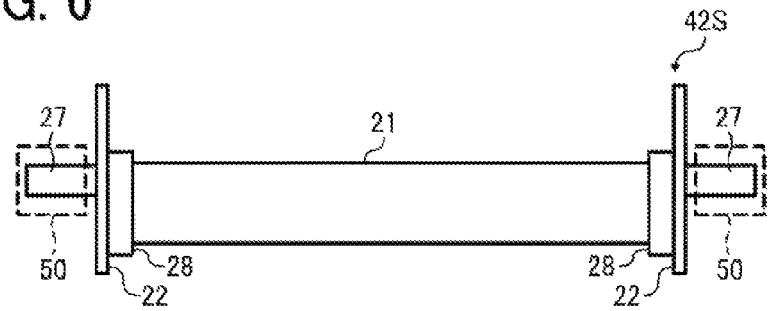
FIG. 6 is a schematic plan view of a first example of the fixing rotator unit incorporated in the fixing device.
Figure 7A:
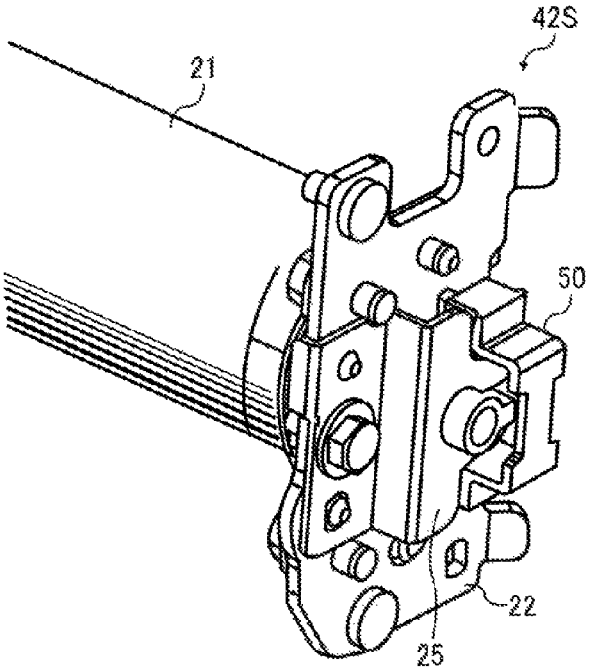
FIG. 7A is a partial perspective view of the fixing rotator unit of FIG. 6.

Referring now to FIGS. 6 and 7A, a description is given of a fixing rotator unit 42S as a first example of the fixing rotator unit 42.

FIG. 6 is a schematic plan view of the fixing rotator unit 42S. FIG. 7A is a partial perspective view of the fixing rotator unit 42S.

Figure 7B:
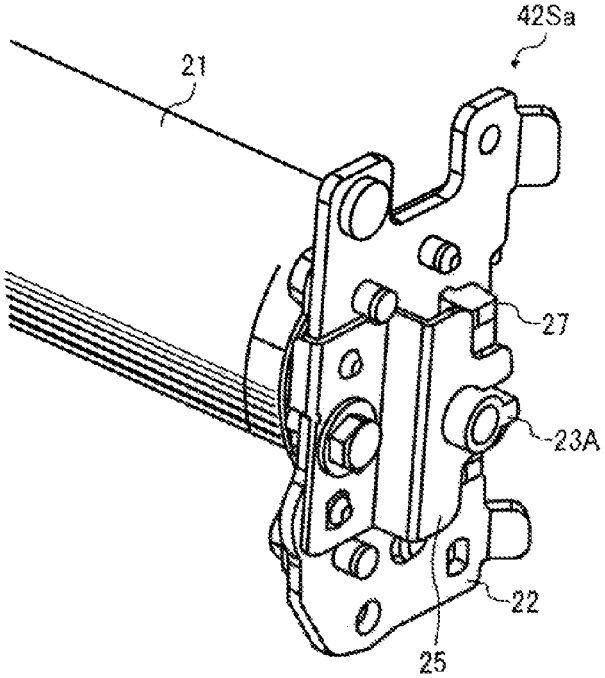
FIG. 7B is a partial perspective view of a variation of the fixing rotator unit of FIG. 7A.

As illustrated in FIGS. 6 and 7A, the fixing rotator unit 42S includes a first regulator 50. The first regulator 50, made of metal or resin, is secured to each lateral end of the stay 27 outside the positioner 22. As described above, the stay 27 is a basic component that determines the relative positions of the fixing belt 21 and the components disposed inside the loop formed by the fixing belt 21. In the fixing rotator unit 42S, the first regulator 50 is secured to each lateral end of the stay 27 at a position that allows the first regulator 50 to regulate the moving distance of the positioner 22 in the width direction of the fixing belt 21 to be shorter than the length of the part 28A, entering the loop formed by the fixing belt 21 as illustrated in FIG. 5A, of the holder 28 when the positioner 22 is opened or moved outwards. FIG. 7B is a partial perspective view of a fixing rotator unit 42S as a variation of the fixing rotator unit 42S. As described above, the stay 27 is disposed through the positioner 22. Since nothing is mounted on each lateral end of the slay 27 outside the positioner 22, the stay 27 might come out of the positioner 22 when the positioner 22 is opened or moved outwards.

Hence, the fixing rotator unit 42Sa includes the heater holder 25 as a regulator that regulates movement of the positioner 22. As described above, the heater holder 25 is secured to the positioner 22 and holds the heater 23. Depending on the length of each lateral end or base portion 23A of the heater 23 exposed from each end lace of the positioner 22, the heater holder 25 may serve as a regulator by limiting the position of the heater holder 25 relative to the positioner 22 in a lateral direction in FIG. 3A.

Figure 8:
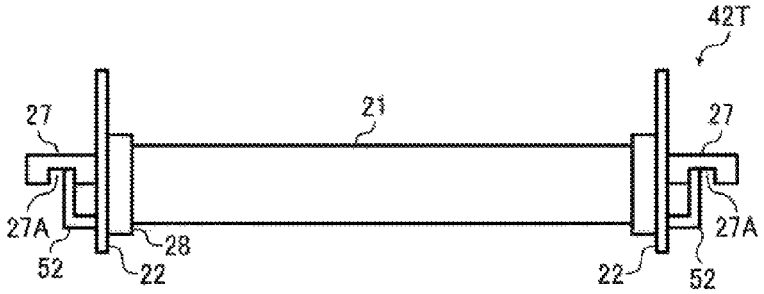
FIG. 8 is a schematic plan view of a second example of the fixing rotator unit incorporated in the fixing device.

Referring now to FIG. 8, a description is given of a fixing rotator unit 42T as a second example of the fixing rotator unit 42.

FIG. 8 is a schematic plan view of the fixing rotator unit 42T.

In the present example, the stay 27 has a recessed portion 27A on a circumferential surface of each lateral end. In addition, the fixing rotator unit 42T includes a regulator 52 as a second regulator. The regulator 52 is secured to an outer surface of the positioner 22 and fitted into the recessed portion 27A. With the recessed portion 27A and the regulator 52, the fixing rotator unit 42T regulates movement of the stay 27 in the thrust direction.

Figure 9:
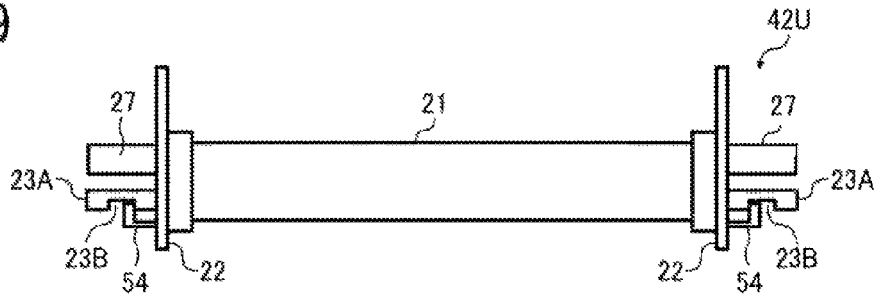
FIG. 9 is a schematic plan view of a third example of the fixing rotator an it incorporated in the fixing device.

Referring now to FIG. 9, a description is given of a fixing rotator unit 42U as a third example of the fixing rotator unit 42.

FIG. 9 is a schematic plan view of the fixing rotator unit 42U.

In the present example, the base portion 23A of the heater 23 has a recessed portion 23B. In addition, the fixing rotator unit 42U includes a regulator 54 as a second regulator. The regulator 54 is secured to the outer surface of the positioner 22 and fitted into the recessed portion 23B. With the recessed portion 23B and the regulator 54, the fixing rotator unit 42U regulates movement of the heater 23 in the thrust direction.

Figure 10:
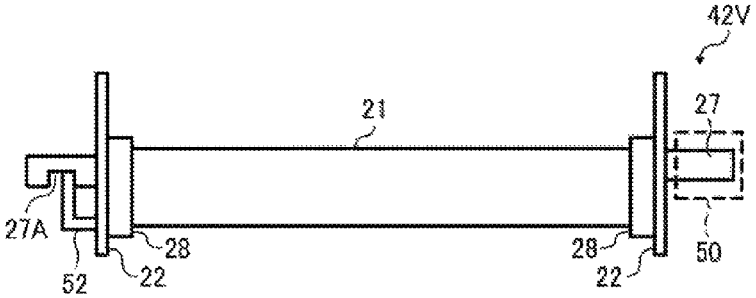
FIG. 10 is a schematic plan view of a fourth example of the fixing rotator unit incorporated in the fixing device.

Referring now to FIG. 10, a description is given of a fixing rotator unit 42V as a fourth example of the fixing rotator unit 42.

FIG. 10 is a schematic plan view of the fixing rotator unit 42V.

The present example relates to a combination of the first example and the second example. Specifically, the regulator 50 as a first regulator is secured to one lateral end of the stay 27. The recessed portion 27A is formed on the circumferential surface of the other lateral end of the stay 27. In addition, the fixing rotator unit 42V includes the regulator 52 as a second regulator. The regulator 52 is secured to the outer surface of the positioner 22 and fitted into the recessed portion 27A.

As described above, in the present embodiment, the moving distance of the positioner 22 in the axial direction (i.e., width direction) of the fixing belt 21 is limited with respect to the length of the part 28A, entering the loop formed by the fixing belt 21, of the holder 28 that holds each lateral end of the fixing belt 21. Accordingly, assembly of the fixing rotator unit 42 is facilitated, and therefore assembly of the fixing device 20 is facilitated, by preventing separation of the fixing belt 21 as a fixing rotator from the holder 28 when the fixing rotator unit 42 is mounted on the housing 40 of the fixing device 20, and therefore preventing damages on the fixing belt 21. Thus, according to an embodiment of the present disclosure, assembly of fixing devices is enhanced by preventing separation of the internal components such as a fixing rotator and a holder from the fixing rotator unit, and therefore preventing damages on the fixing rotator, particularly when the fixing devices include a thin, endless belt or film as a fixing rotator.

The present disclosure has been described above with reference to specific embodiments. It is to be noted that the present disclosure is not limited to the details of the embodiments described above, but various modifications and enhancements are possible without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A fixing device comprising a fixing rotator unit, the fixing rotator unit including:

a fixing rotator formed into a loop;

a holder to hold an end in a longitudinal direction of the fixing rotator;

a pressure rotator disposed opposite the fixing rotator to press against the fixing rotator;

a pressure pad disposed inside the loop formed by the fixing rotator to receive pressure from the pressure rotator via the fixing rotator to form an area of contact between the fixing rotator and the pressure rotator;

a stay to support the pressure pad against the pressure from the pressure rotator; and a positioner to secure the holder and to position the stay with one end of the stay projecting outwards from the positioner, the positioner having a limited moving distance in an axial direction, the limited moving distance being shorter than a length of a part of the holder entering the loop formed by the fixing rotator.

2. The fixing device according to claim 1, wherein the fixing rotator unit further comprises a regulator mounted on the end of the stay to regulate movement of the positioner to the limited moving distance in the axial direction.

3. The fixing device according to claim 1, wherein the fixing rotator unit further comprises a regulator secured to an outer surface of the positioner to regulate movement of the stay in the axial direction so as to regulate movement of the positioner to the limited moving distance in the axial direction.

4. The fixing device according to claim 1, wherein the fixing rotator unit further comprises:

a heater disposed inside the loop formed by the fixing rotator, the heater having an end projecting outwards from the positioner; and a regulator secured to an outer surface of the positioner to regulate movement of the heater in the axial direction so as to regulate movement of the positioner to the limited moving distance in the axial direction.

5. An image forming apparatus comprising:

an image forming device to form a toner image; and a fixing device disposed downstream from the image forming device in a recording medium conveyance direction, the fixing device including a fixing rotator unit, the fixing rotator unit including:

a fixing rotator formed into a loop;

a holder to hold an end in a longitudinal direction of the fixing rotator;

a pressure rotator disposed opposite the fixing rotator to press against the fixing rotator;

a pressure pad disposed inside the loop formed by the fixing rotator to receive pressure from the pressure rotator via the fixing rotator to form an area of contact between the fixing rotator and the pressure rotator;

a stay to support the pressure pad against the pressure from the pressure rotator; and a positioner to secure the holder and to position the stay with one end of the stay projecting outwards from the positioner, the positioner having a limited moving distance in an axial direction, the limited moving distance being shorter than a length of a part of the holder entering the loop formed by the fixing rotator.

* * * * *